US006199225B1

(12) United States Patent
Colvin

(10) Patent No.: US 6,199,225 B1
(45) Date of Patent: Mar. 13, 2001

(54) SHOWER CURTAIN CLOSURE

(76) Inventor: Terry J. Colvin, 125 Tait Rd., Stockbridge, GA (US) 30281

( * ) Notice: Subject to any disclaimer, the term of this patent is extended or adjusted under 35 U.S.C. 154(b) by 0 days.

(21) Appl. No.: 09/149,254

(22) Filed: Sep. 8, 1998

(51) Int. Cl.[7] ..... A47K 3/38
(52) U.S. Cl. ..... 4/558; 4/608
(58) Field of Search ..... 4/558, 608

(56) References Cited

U.S. PATENT DOCUMENTS

| | | | | |
|---|---|---|---|---|
| 3,365,684 | * | 1/1968 | Stemke et al. | 4/608 X |
| 3,808,610 | | 5/1974 | Mortensen | 4/558 |
| 4,077,072 | | 3/1978 | Dezura | 4/558 |
| 4,769,862 | | 9/1988 | Skrzelowski | 4/608 X |
| 4,825,481 | | 5/1989 | Lonberger | 4/608 |
| 5,070,551 | | 12/1991 | Harrison et al. | 4/608 |
| 5,101,522 | | 4/1992 | Prian | 4/558 X |
| 5,148,580 | | 9/1992 | Dyckow | 4/608 X |
| 5,228,149 | * | 7/1993 | Phinn, Jr. | 4/558 |

* cited by examiner

*Primary Examiner*—Robert M. Fetsuga
(74) *Attorney, Agent, or Firm*—William B. Noll

(57) ABSTRACT

The combination of a bath/shower enclosure with an innovative curtain arrangement to eliminate splashing water from exiting the enclosure. The curtain arrangement includes at least one elongated, hook and pile type fastening strip positioned along each vertical edge of the curtain, and a complementary number of such fastening strips, angularly oriented to the curtain fasteners, on the enclosure walls, whereby the curtain may be adjustably and temporarily fastened to the enclosure walls.

4 Claims, 1 Drawing Sheet

SHOWER CURTAIN CLOSURE

FIELD OF THE INVENTION

This invention is directed to the field of shower curtain closures typically used with shower stalls or combination bath/shower enclosures where spraying water often escapes causing slippery floors, or even damage to underlying floor systems.

BACKGROUND OF THE INVENTION

The invention hereof relates to a shower stall curtain closure, or more particularly to the combination of a shower stall or bath enclosure that requires a flexible type curtain, such as made from plastic, where innovative cooperative means are provided to eliminate splashing of water from the stall or enclosure.

Shower bath curtains are often used with bath tubs to convert the bath tub compartment into a shower compartment. The curtains are suspended on a bar at a suitable height above the outside rim of a bath tub with the lower edge of the curtain placed inside the bath tub and with its edges being located against the end walls of the compartment. It is well known that the above arrangement suffers from the drawback of the shower water escaping through an area of corners defined by the bath tub rim and the end walls of the compartment.

The escaped water cannot only be a hazard to the one exiting the shower, by slipping and possibly injuring oneself on the floor, the water can cause permanent damage to the floor or underlying support surface. This can result in costly repairs.

With this recognition and attending problems known for years, the prior art is replete with devices or proposed solutions in an attempt to contain the water within the shower stall or enclosure. The prior art attempts are reflected in the following U.S. patents:

a.) U.S. Pat. No. 5,148,580, to Dyckow, teaches a kit for use to fasten the outer surface of a shower curtain to an adjacent wall in the shower closure. A sealing protrusion extends from the wall adjacent the fasteners so that, when the outer surface of the curtain is fastened to the wall, the edge of the curtain abuts the protrusion.

b.) U.S. Pat. No. 5,101,522, to Prian, relates to a shower curtain support fixture for hanging a shower curtain above a bath tub which includes a generally U-shaped structure having an elongated main portion and a pair of opposite end portions extending generally transverse to the main portion. A slot is defined in a bottom side of the U-shaped structure extending along its main portion and opposite end portions so as to provide a generally U-shaped guide track in the structure. Shower curtain hanger devices are inserted through the slot and slidable individually along the track provided by the slot. Aligned holes formed through the opposite end portions of the structure facilitate mounting of the structure with its opposite end portions extending in flush relation to oppositely facing bathroom walls disposed at opposite ends of the bath tub, such that a shower curtain hanging from the U-shaped structure by the plurality of hanger devices is extendable into the tub and along a front side of the tub and around front opposite corners thereof to effectively block water from spashing out of the tub over the front side and the front opposite corners of the tub.

c.) U.S. Pat. No. 5,070,551, to Harrison et al., discloses a plurality of wall fasteners positioned along the vertical edges of a shower curtain. The wall fasteners maintain the edges of the shower curtain in contiguity with the shower walls between which the curtain is hung. Thus, the water spray from the shower can not splash past the edges of the shower curtain and the enclosure walls. The fasteners mate with a corresponding fasteners on the shower curtain. Approximately the entire vertical edges of the curtain is, thus, sealed against the shower walls to thereby prevent any water from escaping.

d.) U.S. Pat. No. 4,825,481, to Lonberger, is directed to an arrangement for placing a shower curtain within the opening to a combination shower-bathtub enclosure which utilizes clamps, secured to the side or end walls of the enclosure, for the selective gripping of the free edges of the shower curtain when the latter is in a use condition. The preceding prevents unwanted water spray passage into the area outside of the enclosure and, thereby, overcomes a problem which has been commonly encountered heretofore. The clamps, spring-urged to a normally gripping relationship, serve convenience in use.

e.) U.S. Pat. No. 4,769,862, to Skrzelowski, relates to a shower curtain support defined by a track for slidably suspending a shower curtain across the front opening of a shower stall and around the end corners of the support rearwardly at the front opening. End portions of the shower curtain may be drawn around the corners and inside the shower stall to overlap at least a portion of the surface of the stall end walls in order to prevent leaks. Alternately, a continuous curtain support track is provided in a U-shape or other configuration. End pieces attached thereto support a curtain in a plane parallel to the wall surfaces to prevent spraying or splashing outside the shower area.

f.) U.S. Pat. No. 4,077,072, to Dezura, teaches a device for releasably securing to a bath tub compartment at least one end of a shower curtain arranged such that the part of the shower curtain near one vertical edge thereof is not only secured to the generally vertical wall of the compartment, at least a part of the front portion is also secured to the horizontal rim of a bath tub. The curtain thus forms, on releasably fixing same to the compartment, a corner envelope which effectively prevents undesired escape of shower water.

g.) U.S. Pat. No. 3,808,610, to Mortensen, discloses a shower curtain guard for use particularly in connection with shower enclosures above conventional bath tubs. The guard comprises a vertical bar or rail, attached by a double adhesive medium, to the wall at one or both ends of the tub. The rail is bent inwardly above the tub to hold the lower end of the curtain within the tub while affording a wider shower compartment above the tub. A spongy plastic seal prevents escape of water between the tub and the lower end of the bar to rail. Interlocking fibre patches on the curtain and on the rail, which are separable, secure the curtain so as to prevent water passing outside the compartment.

While the prior art offers proposed solutions for containing water within a shower stall or enclosure, none teach a simple, readily adjustable means to accomplish the goal of preventing splashing water from leaving the shower enclosure. The manner by which this simplicity is achieved in the present invention will become more apparent from the following description.

SUMMARY OF THE INVENTION

Invention relates to the combination of a personal shower enclosure, characterized by a pair of parallel, spaced-apart walls to support a shower rod from which is suspended a flexible, slidably mounted shower curtain, and an innovative curtain. The curtain is of a sufficient width to extend between the spaced-apart walls and to be inturned thereagainst. In close proximity to each vertical edge of the shower curtain is at least one fabric-type hook and pile fastener strip, a commercial fastening device sold under the trademark VELCRO. Complementary, transversely oriented fabric-type, hook and pile fastener strips are mounted to the respective spaced-apart walls, adjacent the area of the vertical walls of the curtain, whereby the curtain may be adjustably secured between the spaced-apart walls to eliminate splashing water from escaping the shower enclosure.

Accordingly, an object of this invention is to provide a convenient, yet effective means to protect a shower enclosure, while at the same time allowing easy access to or from the enclosure.

Another object hereof is to provide easy adjustability of the shower curtain protecting the shower enclosure.

These and other objects will become apparent to those skilled in the art from a reading of the following description, particularly when read in conjunction with the accompanying drawings.

DETAILED DESCRIPTION OF PREFERRED EMBODIMENT

Figures 1, 2:
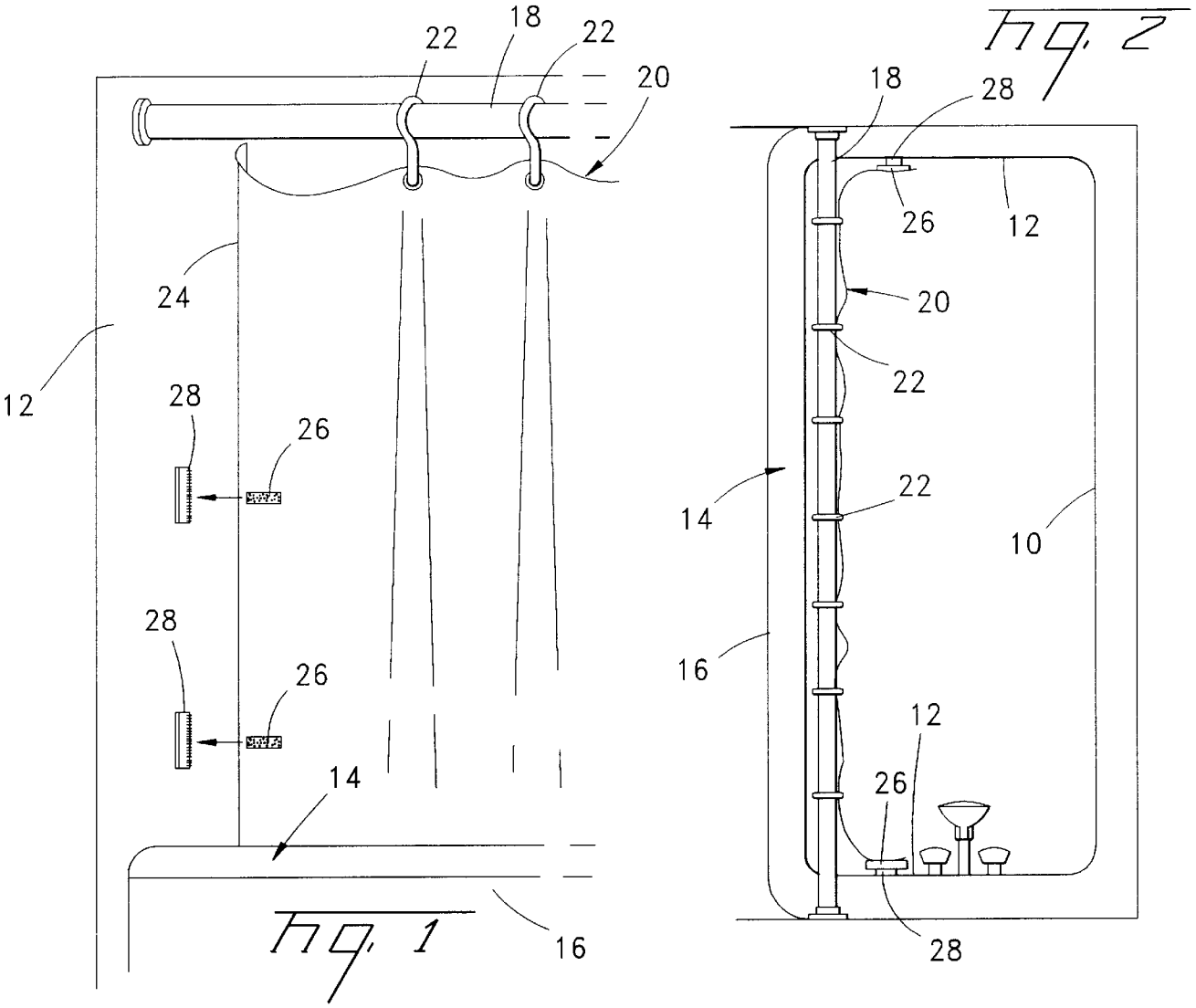
FIG. 1 is a partial, front perspective view of a personal shower enclosure showing the mounting and positioning technique for securing a shower curtain over the opening of the shower enclosure to prevent splashing water escaping therefrom, according to this invention.
FIG. 2 is a top view of a personal shower enclosure utilizing the modified shower curtain hereof.

This invention relates to an effective shower curtain closure that eliminates splashing water from accidentally exiting the bath/shower enclosure. The invention is illustrated in combination with a bath/shower enclosure in the two Figures. Briefly, and by way of background, such enclosure typically includes a back wall 10, a pair of generally parallel, spaced-apart end walls 12, and a tub 14 positioned therewithin, where a front wall 16 of the tub defines an elevated step into the tub for showering. Disposed above the front wall 16 is an extendable rod 18 from which a shower curtain 20, such as made from plastic, may be suspended by plural sliding brackets 22, all as known in the art. A typical plastic curtain 20 includes a reinforced upper seam with holes for receiving about twelve such brackets. Further, as commercially available, the length of the curtain 20 generally exceeds the length of the tub 14 by eight to twelve inches.

Turning specifically to the two Figures, which illustrate the innovative features hereof, the respective end edges 24 are provided with at least one horizontally disposed hook and pile fabric fastening strips 26, a commercial product sold under the trademark, VELCRO. For reasons to become apparent hereafter, the fastening strips are sized on a ratio of at least about 3 to 1, length to width.

On the end walls 12, spaced inwardly from the vertical plane of the extendable rod 18, are positioned at least one elongated hook and pile fastening strip 28, angularly disposed, preferably vertically, relative said fastening strips 26, where such strips are characterized by a length to width ratio of at least 3 to 1. As best seen in FIG. 2, by placing the fastening strip(s) inwardly from the extendable rod 28, the curtain 20 may be turned inwardly and temporarily fastened against the end wall 12. By this simple means, splashing water is effectively contained within the tub 14. Further, by the different angular orientation of the respective, elongated fastening strips 26, 28, adjustment is readily achieved in temporarily securing the curtain 20 to the respective end walls 12. In the event there is insufficient length to wrap the curtain ends against the end walls, the end most brackets 22 may be removed, note FIG. 1.

It is understood that modifications may be made in the features of this invention, particularly by those skilled in the art. Accordingly, no limitation should be imposed on the invention hereof, except as set forth in the appended claims.

What is claimed is:

1. In combination with a personal shower enclosure having at least a pair of spaced-apart, generally parallel enclosure walls adapted to support a horizontally disposed curtain support rod extending therebetween, said combination comprising:

a.) a flexible shower curtain, slidably secured along said curtain support rod, of a length greater than the horizontal length of said curtain support rod, said flexible shower curtain having a generally rectangular configuration with a top edge slidably secured to said curtain support rod, and first and second side edges each containing at least one horizontally disposed hook and pile fabric strip, and b.) at least one vertically oriented hook and pile fabric strip angularly disposed relative to said horizontally disposed hook and pile fabric strip, inwardly spaced from the plane of said curtain support rod, secured to said enclosure walls, whereby the shower curtain may be turned inwardly for adjustable and temporary securement to the respective enclosure walls to confine the water to the shower enclosure.

2. The combination according to claim 1, wherein said respective hook and pile fabric fasteners are elongated, and complementary said fabric fasteners are oriented at about 90 degrees thereto, so as to allow easy adjustability between said complementary fabric fasteners.

3. The combination according to claim 2, wherein each said fabric fastener has a length to width ratio of at least 3 to 1.

4. The combination according to claim 1, wherein each vertical edge of said shower curtain includes plural, spaced-apart said fabric fastener strips.

* * * * *